US005810649A

United States Patent [19]

Oar et al.

[11] Patent Number: 5,810,649

[45] Date of Patent: Sep. 22, 1998

[54] TOOL GUIDE FOR SHARPENING WOODCARVING AND TOOLS

[75] Inventors: Ross C. Oar; Eric J. Oar, both of West Falls, N.Y.

[73] Assignee: Barbara Oar, West Falls, N.Y.

[21] Appl. No.: 846,640

[22] Filed: Apr. 30, 1997

[51] Int. Cl.[6] ..... B24B 19/44

[52] U.S. Cl. ..... 451/378; 451/278; 451/370; 451/389; 451/391; 451/555; 451/558

[58] Field of Search ..... 451/378, 278, 451/555, 558, 349, 552, 370, 389, 391

[56] References Cited

U.S. PATENT DOCUMENTS

| | | | |
|---|---|---|---|
| 1,034,595 | 8/1912 | Dreyer | 451/370 |
| 1,192,416 | 7/1916 | Graves | 451/370 |
| 1,221,556 | 4/1917 | McEachron | 451/370 |
| 1,239,494 | 9/1917 | Lange | 451/370 |
| 1,318,278 | 10/1919 | Jacobson | 451/370 |
| 2,370,908 | 3/1945 | Llorens | 451/378 |
| 4,217,735 | 8/1980 | McGeoch et al. . | |
| 4,733,501 | 3/1988 | McLean . | |
| 5,582,542 | 12/1996 | Stein . | |

*Primary Examiner*—Robert A. Rose
*Assistant Examiner*—George Nguyen
*Attorney, Agent, or Firm*—Bean, Kauffman & Snyder

[57] ABSTRACT

A tool guide for sharpening woodcarving and lathe tools comprises a holder frame having an adjustable clamping member for clamping a portion of a tool against an inner surface thereof, and an adjustable foot member removably connected to the holder frame by a downwardly extending central rod for engaging a work surface which is coplanar with or parallel to a nearby abrasive sharpening surface. The foot member includes an arcuate surface which may be arranged to engage the work surface for sharpening tools having a U-shaped cutting edge profile, and a pair of arc ends which may be arranged to engage the work surface by inverting the foot member for sharpening tools having a straight cutting edge profile. A pair of side rods are spaced on opposite sides of the central rod, whereby distal ends of the side rods and central rod define an angular profile for sharpening tools having a V-shaped cutting edge when the foot member is removed.

13 Claims, 4 Drawing Sheets

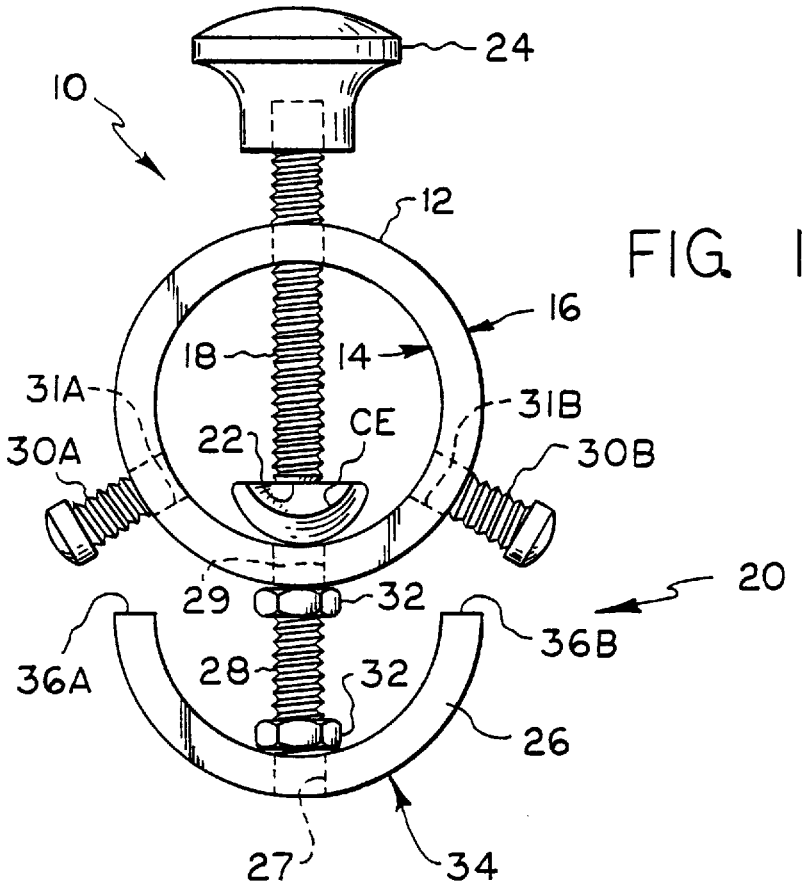
FIG. 1
FIG. 2
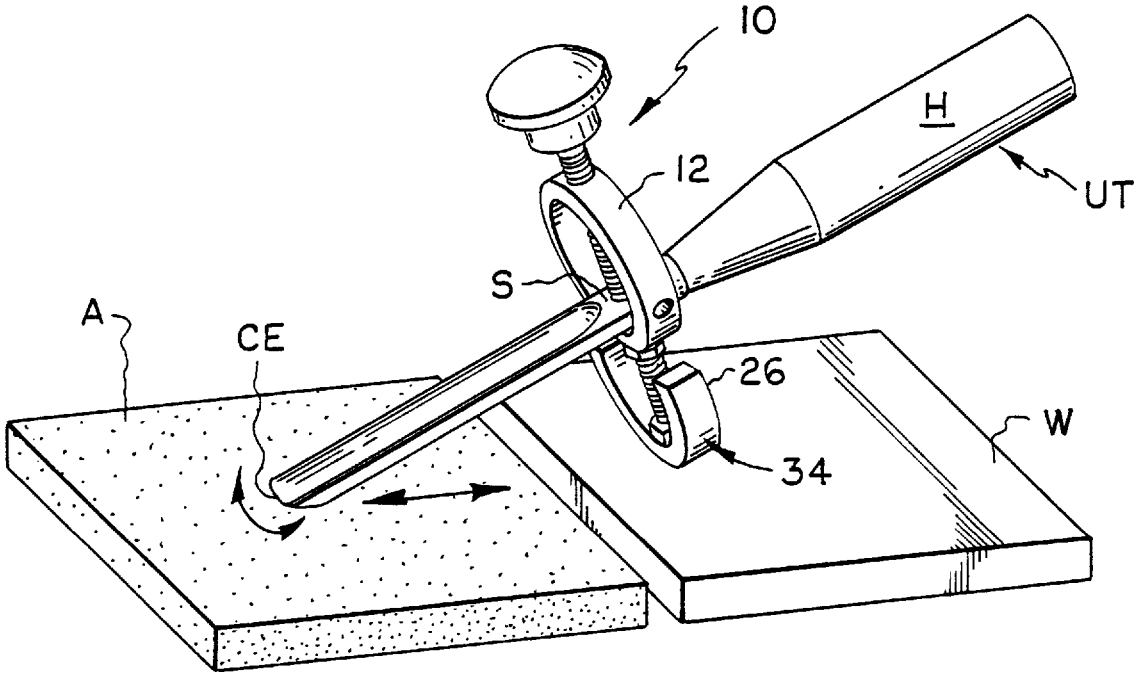

TOOL GUIDE FOR SHARPENING WOODCARVING AND TOOLS

BACKGROUND

A. Field of the Invention

The present invention relates generally to the art of woodcarving and wood turning, and more particularly to a multi-functional tool guide for holding and guiding a carving tool or lathe tool during sharpening of the tool's cutting edge against an abrasive surface.

B. Description of the Prior Art

Woodcarving and lathe tools are generally classified based on blade profile into several basic categories including the U-gouge, the straight chisel, the skew chisel and the V-gouge. As part of the procedure used for sharpening such tools, a beveled underside of the tool blade tip is ground against an abrasive surface to reform the cutting edge of the tool. During sharpening, it is important that the tool be kept at a constant angle while the tip is moved back and forth over the abrasive surface, or while the tip is held stationary against a rotating grinding wheel. If the tool angle is varied during grinding, the cutting edge will be slightly rounded and thus inefficient for its intended purpose. In the case of a U-gouge, a careful lateral rocking motion is typically used to sharpen every part of the curved cutting edge in an even manner. In the case of a V-gouge, one side of the angular cutting edge is sharpened at a time.

An apparatus known as a "honing guide" is often used during finer sharpening of straight chisels. A typical honing guide includes a body having means for holding a tool at a fixed sharpening angle relative to an abrasive sharpening surface and wheel/roller means rotatably mounted on a transverse axle for facilitating back and forth motion of the honing guide and tool held thereby. U.S. Pat. No. 4,733,501 an example of this type of honing guide honing guide.

More complex devices for sharpening cutting tools are also known. For example, U.S. Pat. No. 4,217,735 discloses device having a base with an upwardly directed abrasive surface, and an upstanding tool carriage overlying the abrasive surface and mounted to the base for reciprocating linear movement. The carriage includes a threadably adjustable clamping block for holding a tool, and means for adjusting the elevation and angle of the tool relative to the abrasive surface. A pendulum assembly is provided for attachment to the carriage to enable lateral rocking motion for sharpening a U-gouge tool. U.S. Pat. No. 5,582,542 discloses an upstanding frame having attachable means for holding a straight chisel at a selected angle relative to a moving abrasive surface. A base of the frame is connected to a support platform by spring-biased hinge means, whereby a beveled tip of the tool is biased under uniform pressure for engagement with the abrasive surface.

The tool guides described above are complex and expensive to manufacture, and/or lack versatility for sharpening a variety of tools having different cutting edge profiles.

SUMMARY OF THE INVENTION

It is a primary object of the present invention to provide a tool guide capable of holding and guiding a woodcarving or lathe tool at a substantially constant angle during sharpening of a cutting edge of the tool against an abrasive surface, and which may be specifically adapted for sharpening a tool having a U-shaped cutting edge profile, a straight cutting edge profile, or a V-shaped cutting edge profile.

It is another object of the present invention to provide a tool guide for sharpening a woodcarving or lathe tool which is inexpensive and easy to use.

In view of these and other objects, a manually operable tool guide according to a preferred embodiment of the present invention includes an annular holder frame having a radially adjustable clamp member for clamping a portion of a tool to be sharpened, for instance the shank, against an inner surface of the holder frame, and foot means for engaging a work surface arranged proximate to, and preferably coplanar with, the abrasive sharpening surface. With the tool clamped in place to extend axially relative to the holder frame, the tool guide may be tilted to bring a beveled tip of the tool in contact with the abrasive surface at a given sharpening angle. The foot means includes an arcuate foot member connected to the holder frame by a central rod aligned with the clamp member and extending downwardly from the holder frame. The foot means further includes a pair of threaded side rods extending generally downwardly from the holder frame and spaced on opposite sides of the central rod.

To use the tool guide of the present invention to sharpen a tool having a U-shaped cutting edge profile, the foot member is orientated such that an arcuate surface thereof is arranged to engage the work surface, whereby both lateral rocking motion and back-and-forth motion of the tool guide and tool may be undertaken in a guided manner. To sharpen a straight chisel or straight edge turning tool, the foot member is inverted such that a pair of arc ends of the foot member which define a linear profile are arranged to engage the work surface. In the case of a skew chisel, the foot member may be rotated about the axis of the central connecting rod such that the line defined by the arc ends is parallel to the cutting edge of the skew chisel. To sharpen a tool having a V-shaped (angular) cutting edge profile, the foot member is completely removed from the central rod, and the ends of the central rod and two side rods define a corresponding angular profile for slidable engagement with the work surface.

An adapter arm having auxiliary clamping means is also provided to permit guided sharpening of woodcarving knives, which must be arranged to extend in a transverse direction during sharpening.

BRIEF DESCRIPTION OF THE DRAWINGS

The nature and mode of operation of the present invention will now be more fully described in the following detailed description of the preferred embodiments taken with the accompanying drawing figures, in which:

FIG. 1 is a front elevational view of a tool guide formed in accordance with a preferred embodiment of the present invention, with the cutting edge profile of a U-gouge tool held by the tool guide also being shown;

FIG. 2 is a perspective view showing operation of the tool guide of FIG. 1 for sharpening a U-gouge tool;

DETAILED DESCRIPTION OF THE PREFERRED EMBODIMENTS

Figure 3:
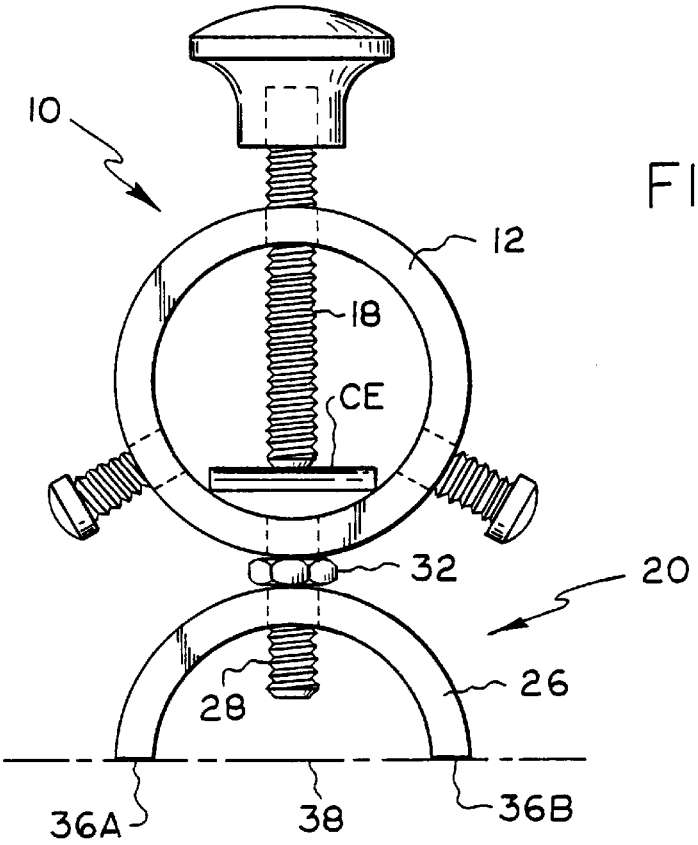
FIG. 3 is a front elevational view showing the tool guide of the preferred embodiment with foot means thereof being adjusted for sharpening a straight chisel, with the cutting edge profile of a straight chisel held by the tool guide also being shown.

Reference is made initially to FIG. 1 of the drawings, wherein a tool guide formed in accordance with a preferred embodiment of the present invention is shown and identified generally by the reference numeral 10. Tool guide 10 includes an annular holder frame 12 having an inner surface 14 and an outer surface 16; a threaded clamp member 18 extending radially through a threaded hole in holder frame 12; and foot means 20 connected to holder frame 12. The component parts of tool guide 10 should be constructed of rigid material, for example steel or other metal.

Referring also now to FIG. 2, a tool UT passes axially through holder frame 12 and is clamped against inner surface 14 of holder frame 12 by a clamping end 22 of clamp member 18 located internally of the holder frame. A knob 24 is preferably provided at a second end of clamp member 18 located externally of holder frame 12 to facilitate manual rotation of the clamp member to bring clamping end 22 closer to or further from inner surface 14. As will be understood, inner surface 14 functions as a clamping surface against which a selected portion of tool UT may be releasably held by clamp member 18. The portion of tool UT which is chosen for clamping will depend on the specific tool dimensions and the desired sharpening angle. While FIG. 2 shows a shank portion S of tool UT being clamped, any portion of handle H may also be particularly suitable for clamping.

Foot means 20 of the present invention is designed to engage a work surface W proximate to, and preferably coplanar with, an abrasive surface A against which tool UT is sharpened so as to maintain the tool at a substantially constant angle during back and forth motion of the tool. Moreover, foot means 20 is selectively adjustable to perform this function with respect to a U-gouge, a straight chisel, a skew chisel, or a V-gouge tool.

As shown in FIG. 1, foot means 20 comprises a foot member 26 connected to holder frame 12 by a threaded central rod 28 extending radially downward from holder frame 12 in alignment with clamp member 18 and received within a threaded, intermediately-located hole 27 through the foot member. Foot member 26 may be temporarily fixed in a selected position relative to holder frame 12 by nuts 32. Foot means 20 further includes a pair of threaded, radially and downwardly extending side rods 30A,30B angularly spaced from, and on opposite sides of, central rod 28. Rods 28, 30A, and 30B are received within respective threaded holes 29, 31A and 31B extending radially through holder frame 12 from inner surface 14 through outer surface 16. Side rods 30A and 30B are each preferably spaced sixty degrees from central rod 28 and one-hundred twenty degrees from clamp member 18, as measured from their respective axes. While the primary function of side rods 30A,30B relates to foot means 20, it will appreciated that they may be used as set screws in cooperation with clamp member 18 to secure a tool within holder frame 12.

In accordance with the present invention, foot member 26 includes an arcuate surface 34 corresponding, although at a larger scale, to the profile of the cutting edge CE of U-gouge tool UT, and a pair of arc ends 36A and 36B. As best seen in FIG. 2, foot member 26 may be connected to holder frame 12 in the depicted orientation, with arc ends 36A,36B facing upward, such that an edge of arcuate surface 34 engages work surface W. Tool guide 10 must be tilted to bring the tip of tool UT into contact with abrasive surface A at an angle suitable for sharpening cutting edge CE. Adjustment of the sharpening angle may be made by changing the location at which tool UT is clamped to holder frame 12, and/or by threadably adjusting the distance between holder frame 12 and foot member 26. As will be appreciated, the arcuate profile of the work-surface engaging portion of foot member 26 enables lateral rocking motion of both tool guide 10 and tool UT in addition to back and forth sliding motion, thereby accomplishing substantially even sharpening of the U-gouge cutting edge.

Figure 4:
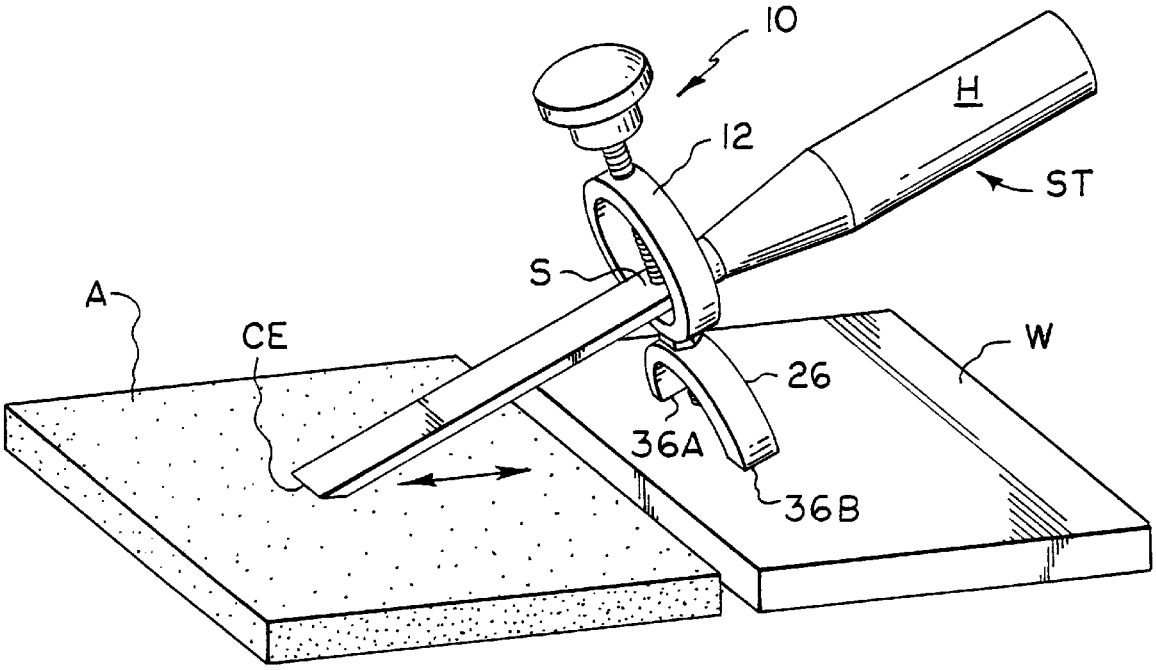
FIG. 4 is a perspective view showing operation of the tool guide of FIG. 3 for sharpening a straight chisel.

Referring now to FIGS. 3 and 4, foot member 26 is shown in an inverted orientation relative to that shown in FIGS. 1 and 2, whereby arc ends 36A,36B are arranged to engage work surface W and serve to define a linear profile indicated by phantom line 38 for the purpose of sharpening the cutting edge CE of a straight chisel or straight edge turning tool ST. Since the engagement portion of foot means 20 defines a linear profile corresponding to the cutting edge profile of tool ST, the tool is maintained at a constant sharpening angle by tool guide 10 for uniform sharpening along the length of the linear cutting edge CE. When sharpening a straight chisel or straight edge turning tool using tool guide 10, it is important to maintain both arc ends 36A,36B in engagement with work surface W while tool guide 10 and the tool are moved back and forth.

A skew chisel, which is similar to a straight chisel in that it has a linear cutting edge profile, but which differs from a straight chisel in that its cutting edge is not perpendicular to the longitudinal axis of the tool when viewed in top plan, may also be sharpened using tool guide 10 in a manner generally similar to that depicted in FIG. 4. However, for sharpening a skew chisel, foot member 26 is rotated about the axis of central rod 28 such that arc ends 36A,36B define a line parallel to the cutting edge when viewed in top plan.

Figure 5:
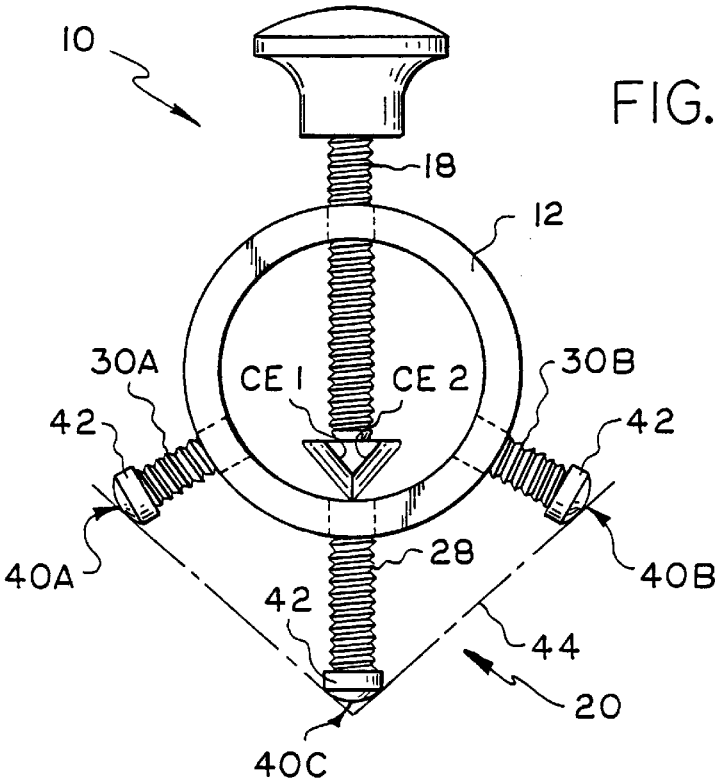
FIG. 5. is a front elevational view showing the tool guide of the preferred embodiment with foot means thereof being adjusted for sharpening a V-gouge tool, with the cutting edge profile of a V-gouge tool held by the tool guide also being shown.
Figure 6:
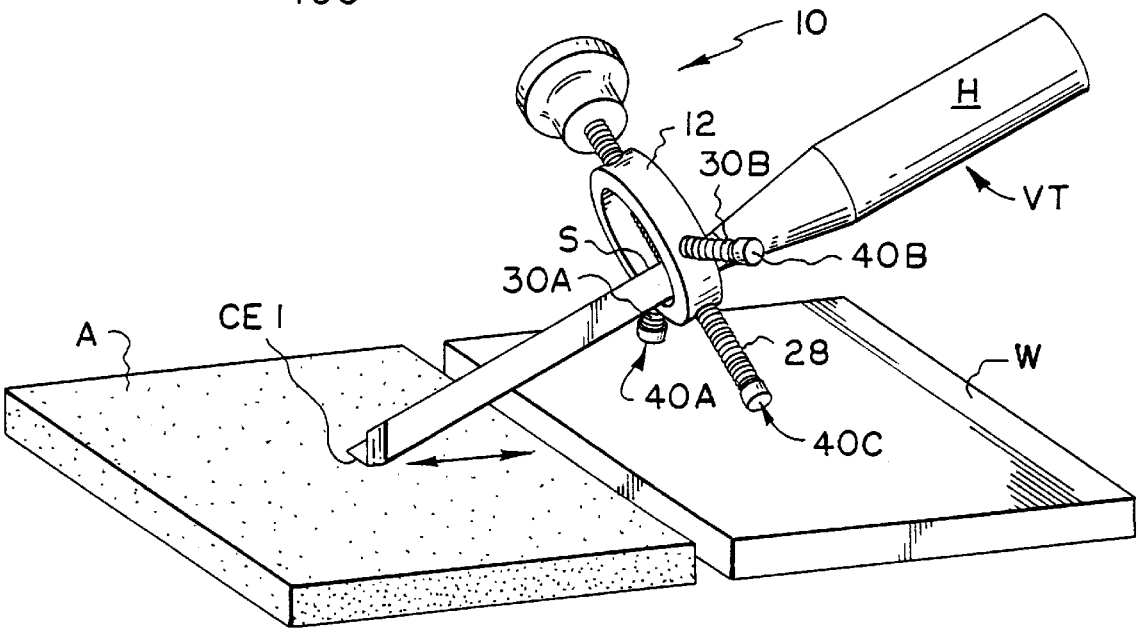
FIG. 6 is a perspective view showing operation of the tool guide of FIG. 5 for sharpening a V-gouge tool.

FIGS. 5 and 6 depict foot means 20 in a third operative condition for sharpening the cutting edge CE1,CE2 of a V-gouge tool VT, wherein foot member 26 is disconnected from holder frame 12. Each of the side rods 30A,30B and central rod 28 terminates at a respective rod end 40A, 40B, and 40C distal to holder frame 12. The rod ends 40A–40C are preferably covered by smooth caps 42 which slide easily along work surface W without scratching, and are suitably positioned to define an angular profile as illustrated by phantom line 44, wherein central rod end 40C defines the vertex of angular profile 44. The included angle of angular profile 44 is adjustable to correspond to the cutting edge V-angle of a tool VT, typically ninety, seventy-five, or sixty degrees, by threadably moving side rods 30A,30B and/or central rod 28 radially inward or outward depending on the desired angle. It is also contemplated that central rod 28 and side rods 30A,30B be interchangeable with different length rods as necessary to define a particular angular profile and achieve a desired sharpening angle. As may be understood from FIG. 6, each one of the pair of side cutting edges CE1 and CE2 making up the angular cutting edge of tool VT is sharpened separately in a manner similar to that described above for a straight chisel, with either rod ends 40A and 40C or rod ends 40B and 40C in continuous contact with work surface W. To switch from one side edge CE1 or CE2 to the other side edge, tool guide 10 and tool VT are merely pivoted about central rod end 40C to bring the opposite side rod end 40A or 40B into engagement with work surface W.

Figure 7:
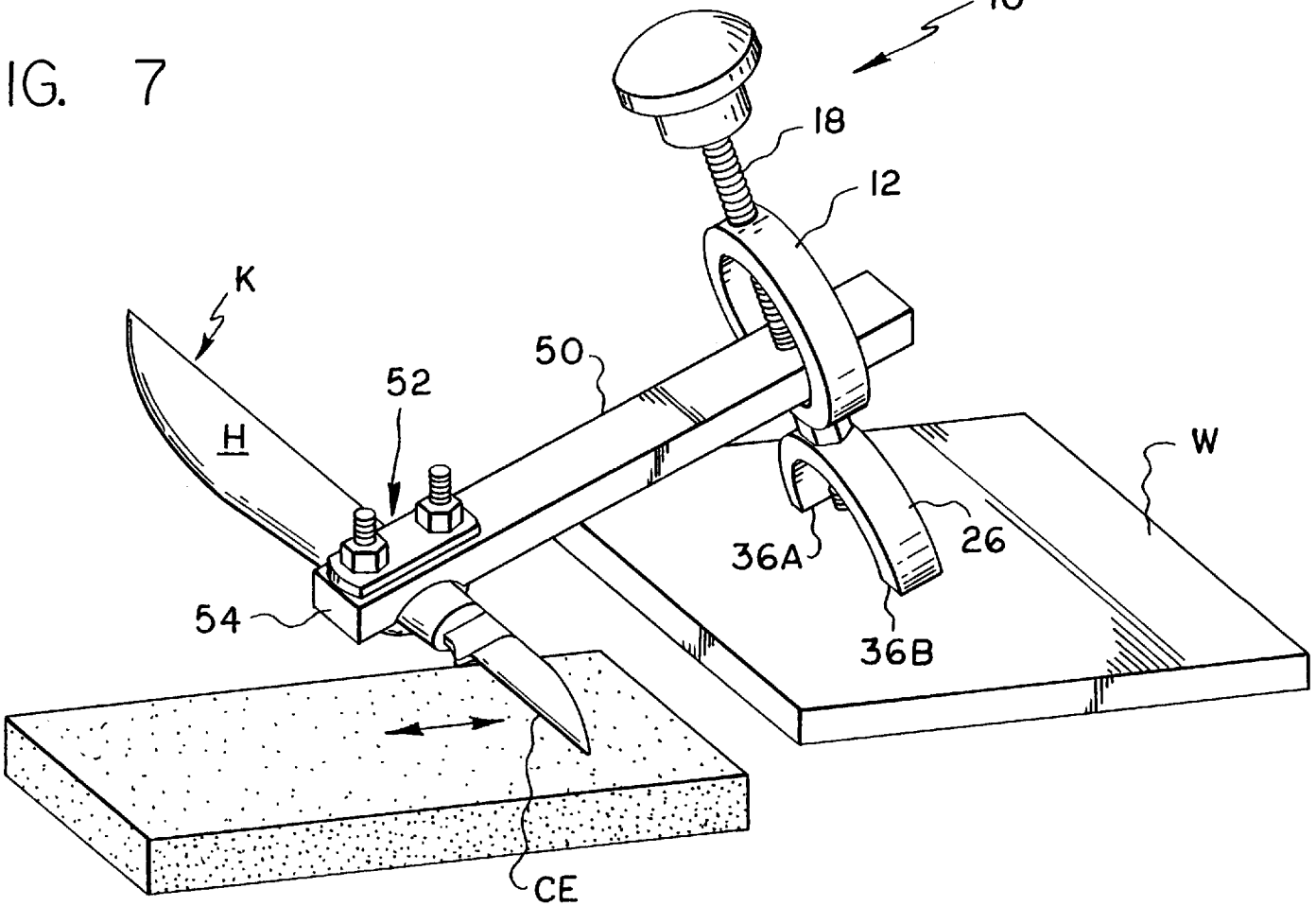
FIG. 7 is a perspective view showing operation of the tool guide of FIG. 3 in conjunction with an adapter arm of the present invention for sharpening a woodcarving knife.

In FIG. 7 there is shown an elongated adapter arm 50 for use with tool guide 10 to facilitate even sharpening of the cutting edge CE of a woodcarving knife K in accordance with the present invention. Adapter arm 50 is sized for receipt within holder frame 12 to permit clamping thereof against inner surface 14 by clamp member 18, such that, adapter arm 50 extends in an axial direction relative to holder frame 12, similar to the tools UT, ST, and VT shown in FIGS. 2, 4, and 6, respectively. Adapter arm 50 includes auxiliary clamping means 52, such as a curved bracket connected to the adapter arm by a wing nut, or in the alternative a U-bolt, at or near a distal end 54 thereof for securely holding the elongated handle H of knife K when the handle is arranged to extend in a transverse direction substantially perpendicular to the axial direction in which the adapter arm extends, with cutting edge CE facing away from tool guide 10. The foot member 26 is connected to holder frame 12 in the orientation shown in FIGS. 3 and 4 and described above in connection with sharpening a straight chisel. Once again, it is important to maintain both arc ends 36A,36B in engagement with work surface W while tool guide 10 and knife K are moved back and forth.

It will be understood that work surface W should either be parallel to or coplanar with abrasive surface A for intended results using the present invention, and that abrasive surface A may be a moving surface such as the surface of a grinding wheel.

What is claimed is:

1. A tool guide for sharpening the cutting edge of a tool against an abrasive surface, said tool guide comprising:

a holder frame having a clamping surface and means for releasably clamping a selected portion of said tool against said clamping surface; and foot means connected to said holder frame for engaging a work surface arranged proximate to said abrasive surface, said foot means having an engagement portion defining a profile corresponding to a profile of said cutting edge, wherein said engagement portion defines an arcuate profile for sharpening a U-gouge tool.

2. A tool guide for sharpening the cutting edge of a tool against an abrasive surface, said tool guide comprising:

a holder frame having a clamping surface and means for releasably clamping a selected portion of said tool against said clamping surface; and foot means connected to said holder frame for engaging a work surface arranged proximate to said abrasive surface, said foot means having an engagement portion defining a profile corresponding to a profile of said cutting edge, wherein said engagement portion defines an angular profile for sharpening a V-gouge tool.

3. The tool guide according to claim 2, wherein said foot means includes a central rod and a pair of side rods spaced from said central rod on opposite sides thereof, each of said central and side rods extending from said holder frame and terminating at a distal rod end, and said angular profile is defined by said rod ends of said central rod and said pair of side rods.

4. The tool guide according to claim 3, wherein said central rod and said side rods are adjustable relative to said holder frame for changing an angle of said angular profile.

5. The tool guide according to claim 4, wherein said central rod and said side rods are threaded rods received within threaded holes in said holder frame.

6. A tool guide for sharpening the cutting edge of a tool against an abrasive surface, said tool guide comprising:

a holder frame having a clamping surface and means for releasably clamping a selected portion of said tool against said clamping surface; and foot means connected to said holder frame for engaging a work surface arranged proximate to said abrasive surface, said foot means having a plurality of engagement portions each defining a different profile, and said foot means is adjustable relative to said holder frame for choosing a desired one of said plurality of engagement portions.

7. The tool guide according to claim 6, wherein said plurality of engagement portions includes a first engagement portion defining an arcuate profile for sharpening a U-gouge tool and a second engagement portion defining a linear profile for sharpening a straight chisel.

8. The tool guide according to claim 6, wherein said plurality of engagement portions includes a first engagement portion defining an arcuate profile for sharpening a U-gouge tool and a second engagement portion defining an angular profile for sharpening a V-gouge tool.

9. The tool guide according to claim 6, wherein said plurality of engagement portions includes a first engagement portion defining a linear profile for sharpening a straight chisel and a second engagement portion defining an angular profile for sharpening a V-gouge tool.

10. The tool guide according to claim 6, wherein said plurality of engagement portions includes a first engagement portion defining an arcuate profile for sharpening a U-gouge tool, a second engagement portion defining a linear profile for sharpening a straight chisel, and a third engagement portion defining an angular profile for sharpening a V-gouge tool.

11. The tool guide according to claim 6, further including an elongated adapter arm sized for clamping by said clamping means to extend in an axial direction relative to said holder frame, said adapter arm having auxiliary clamping means for holding an elongated tool handle extending in a transverse direction substantially perpendicular to said axial direction.

12. The tool guide according to claim 7, wherein said foot means includes a foot member having an arcuate surface for defining said arcuate profile and a pair of arc ends for defining said linear profile, and threaded central rod for selectively connecting said foot member to said holder frame in a first orientation wherein said arcuate surface is arranged to engage said work surface and in a second orientation wherein said arc ends are arranged to engage said work surface.

13. The tool guide according to claim 12, wherein said foot member is rotatable about an axis of said central rod for positioning said arc ends to define a line parallel to a cutting edge of a skew chisel.

* * * * *